US011179942B2

(12) United States Patent
Naito et al.

(10) Patent No.: US 11,179,942 B2
(45) Date of Patent: Nov. 23, 2021

(54) LIQUID EJECTION SYSTEM AND LIQUID STORAGE CONTAINER

(71) Applicant: SEIKO EPSON CORPORATION, Tokyo (JP)

(72) Inventors: Naoki Naito, Ikeda-machi (JP); Takeshi Komaki, Shiojiri (JP); Noriyuki Fukasawa, Matsumoto (JP); Takanori Matsuda, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/824,764

(22) Filed: Mar. 20, 2020

(65) Prior Publication Data

US 2020/0298576 A1 Sep. 24, 2020

(30) Foreign Application Priority Data

Mar. 22, 2019 (JP) ..... JP2019-054883

(51) Int. Cl.
*B41J 2/175* (2006.01)

(52) U.S. Cl.
CPC ..... *B41J 2/17523* (2013.01); *B41J 2/1752* (2013.01); *B41J 2/1753* (2013.01); *B41J 2/17509* (2013.01); *B41J 2/17553* (2013.01)

(58) Field of Classification Search
CPC .. B41J 2/17503; B41J 2/17509; B41J 2/1752; B41J 2/17523; B41J 2/1753; B41J 2/17546; B41J 2/17553
See application file for complete search history.

(56) References Cited

U.S. PATENT DOCUMENTS

| | | | | |
|---|---|---|---|---|
| 8,297,738 | B1 * | 10/2012 | Kodama | B41J 2/1752 347/49 |
| 8,985,743 | B2 * | 3/2015 | Sasaki | B41J 2/17523 347/49 |
| 9,452,611 | B2 * | 9/2016 | Kimura | B41J 29/02 |
| 10,543,692 | B2 * | 1/2020 | Ishizawa | B41J 2/14 |
| 2007/0040874 | A1 * | 2/2007 | Matsumoto | B41J 2/17513 347/85 |
| 2016/0031224 | A1 | 2/2016 | Aoki et al. | |

FOREIGN PATENT DOCUMENTS

JP 2017-024423 A 2/2017

* cited by examiner

*Primary Examiner* — Anh T Vo
(74) *Attorney, Agent, or Firm* — Oliff PLC

(57) ABSTRACT

A liquid ejection system includes: a liquid ejection apparatus; and a liquid storage container, wherein the liquid ejection apparatus includes a mounting unit having an apparatus-side terminal portion that is elastically deformable in a mounting direction, and an apparatus-side locking portion that restricts the liquid storage container from moving in a direction opposite to the mounting direction of the liquid storage container, and the liquid storage container includes a top surface located on an upper side in a vertical direction in a mounted state in which the liquid storage container is mounted, a container-side locking portion, the container-side locking portion being provided on the top surface, and a container-side terminal portion coupled to the apparatus-side terminal portion, the container-side terminal portion being provided at a position closer to the top surface than to a center of the liquid storage container in the vertical direction.

5 Claims, 6 Drawing Sheets

LIQUID EJECTION SYSTEM AND LIQUID STORAGE CONTAINER

The present application is based on, and claims priority from JP Application Serial Number 2019-054883, filed Mar. 22, 2019, the disclosure of which is hereby incorporated by reference herein in its entirety.

BACKGROUND

1. Technical Field

The present disclosure relates to a liquid ejection system and a liquid storage container.

2. Related Art

There have been known printing material supply systems as liquid ejection systems having a contact portion between apparatus-side terminals and cartridge terminals. JP-A-2017-24423 is an example of related art. The apparatus-side terminals are terminals provided in the printing apparatus, which is a liquid ejection apparatus. The cartridge terminals are terminals provided on a cartridge that is mounted in the printing apparatus. In such a printing material supply system, the cartridge terminals are formed on a substrate disposed to be inclined at a corner portion where the front surface and the top surface of the cartridge intersect with each other.

In the related art, when a float type terminal section that can be displaced by elastically deforming is used as a terminal portion including the apparatus-side terminals, a rotation force is imparted to the cartridge by a biasing force applied from the apparatus-side terminals to the cartridge in mounting of the cartridge in a holder. When the rotation force is imparted to the cartridge, there may be a case where a mounting position of the cartridge in the holder is misaligned, which may cause contact failure between the cartridge terminals and the apparatus-side terminals.

SUMMARY

According to an aspect of the disclosure, a liquid ejection system is provided. The liquid ejection system includes: a liquid ejection apparatus that ejects liquid; and a liquid storage container that is detachably mounted in the liquid ejection apparatus, the liquid storage container storing the liquid to be ejected by the liquid ejection apparatus, wherein the liquid ejection apparatus includes: a mounting unit in which the liquid storage container is mounted, the mounting unit having an apparatus-side terminal portion that is elastically deformable at least in a horizontal direction which is parallel to a mounting direction of the liquid storage container, and an apparatus-side locking portion that restricts the liquid storage container from moving in a direction opposite to the mounting direction, and the liquid storage container includes: a top surface that is located on an upper side in a vertical direction in a mounted state in which the liquid storage container is mounted in the mounting unit; a container-side locking portion locked by the apparatus-side locking portion, the container-side locking portion being provided on the top surface; and a container-side terminal portion configured to be coupled to the apparatus-side terminal portion, the container-side terminal portion being provided at a position closer to the top surface than to a center of the liquid storage container in the vertical direction.

DESCRIPTION OF EXEMPLARY EMBODIMENTS

A. Embodiment

Figure 1:
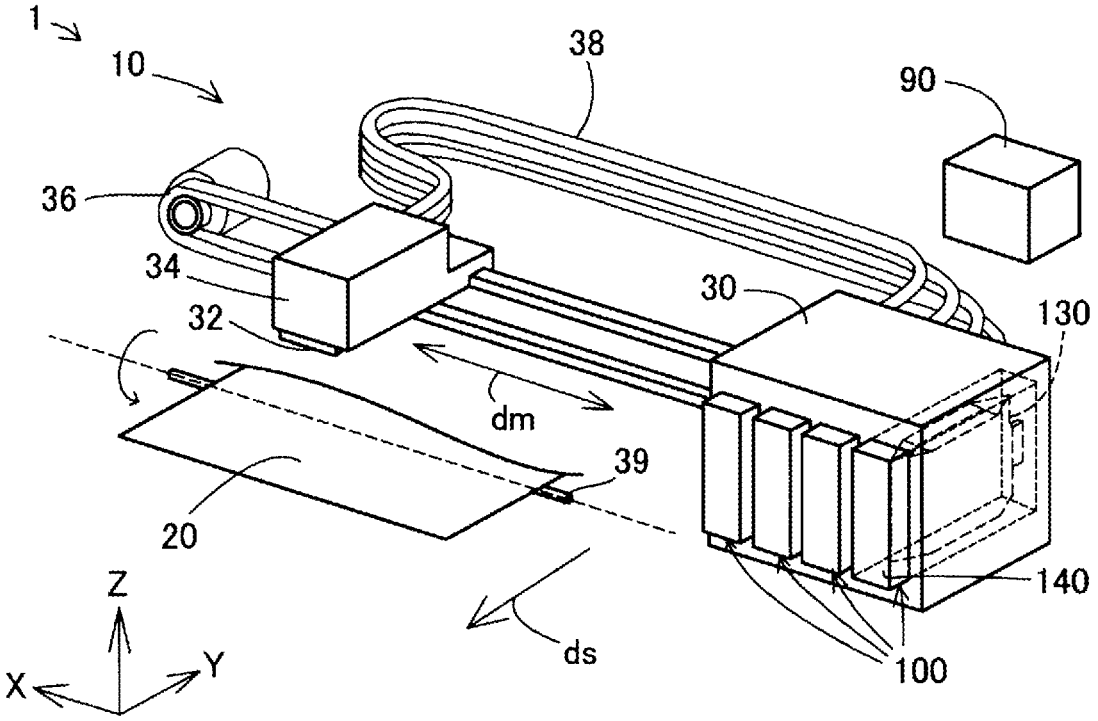
FIG. 1 is a schematic diagram of a liquid ejection apparatus.

FIG. 1 is a schematic diagram of a liquid ejection system 1. The liquid ejection system 1 includes a liquid ejection apparatus 10 and a liquid storage container 100. The liquid ejection apparatus 10 is an apparatus that ejects liquid onto a medium 20, and holds the liquid on the medium 20. The liquid ejection apparatus 10 is a so-called ink jet printer, which is configured to eject ink as a liquid to thereby perform printing on the medium 20. The medium 20 is a printing medium such as a paper sheet, plate member, or cloth. The ink may be, for example, a water-based ink or a solvent ink. FIG. 1 shows the X, Y, and Z axes, which are three spatial axes that are orthogonal to one another. The direction extending along the X axis is referred to as an X direction, the direction extending along the Y axis is referred to as a Y direction, and the direction extending along the Z axis is referred to as a Z direction. The liquid ejection apparatus 10 is placed on an XY plane, which is a plane parallel to the X direction and the Y direction. The Z direction is a vertical direction, and the +Z direction and the −Z direction are a vertically upward direction and a vertically downward direction, respectively. In other drawings described below, the X, Y, and Z axes are also indicated as necessary.

The liquid ejection apparatus 10 includes a liquid storage container 100, a mounting unit 30 for accommodating the liquid storage container 100, a carriage 34 having a head 32 for ejecting liquid to the outside, a drive mechanism 36, a transport mechanism 39 that transports the medium 20, and a control unit 90. The drive mechanism 36 drives the carriage 34 in a main scan direction dm, which extends along the X direction. The transport mechanism 39 transports the medium 20 in a sub-scan direction ds, which is a direction intersecting the main scan direction dm, for example, perpendicular to the main scan direction dm. The sub-scan direction ds is the −Y direction. The control unit 90 controls various operations, for example, a printing operation, of the liquid ejection apparatus 10. The liquid ejection apparatus 10 is an off-carriage type ink jet printer. In the off-carriage type ink jet printer, the mounting unit 30 is not configured to move together with the driving of the carriage 34.

The liquid storage container 100 is a container that can store liquid therein. The liquid storage container 100 includes a liquid storage body 130, which is a bag defining an internal space for storing liquid, and a case 140, which is a housing for accommodating the liquid storage body 130 therein. The case 140 is made of a synthetic resin such as polypropylene or polyethylene. The liquid storage container 100 is detachably mounted in the mounting unit 30. In the present embodiment, the liquid storage container 100 is mounted in the mounting unit 30 by being inserted through an opening of the mounting unit 30 toward inside in the horizontal direction, that is, +Y direction. Further, the liquid storage container 100 is detached from the mounting unit 30 by being pulled out from the mounting unit 30 in the −Y direction. In the following description, the Y direction is also referred to as a mounting/detaching direction, and the +Y direction and the −Y direction are also referred to as a mounting direction and a detaching direction, respectively.

The mounting unit 30 is provided with a tube 38 that allows liquid to flow from the liquid storage container 100 to the head 32. The tube 38 and the liquid storage container 100 are coupled to each other via a liquid outlet needle, which is not shown.

Figure 2:
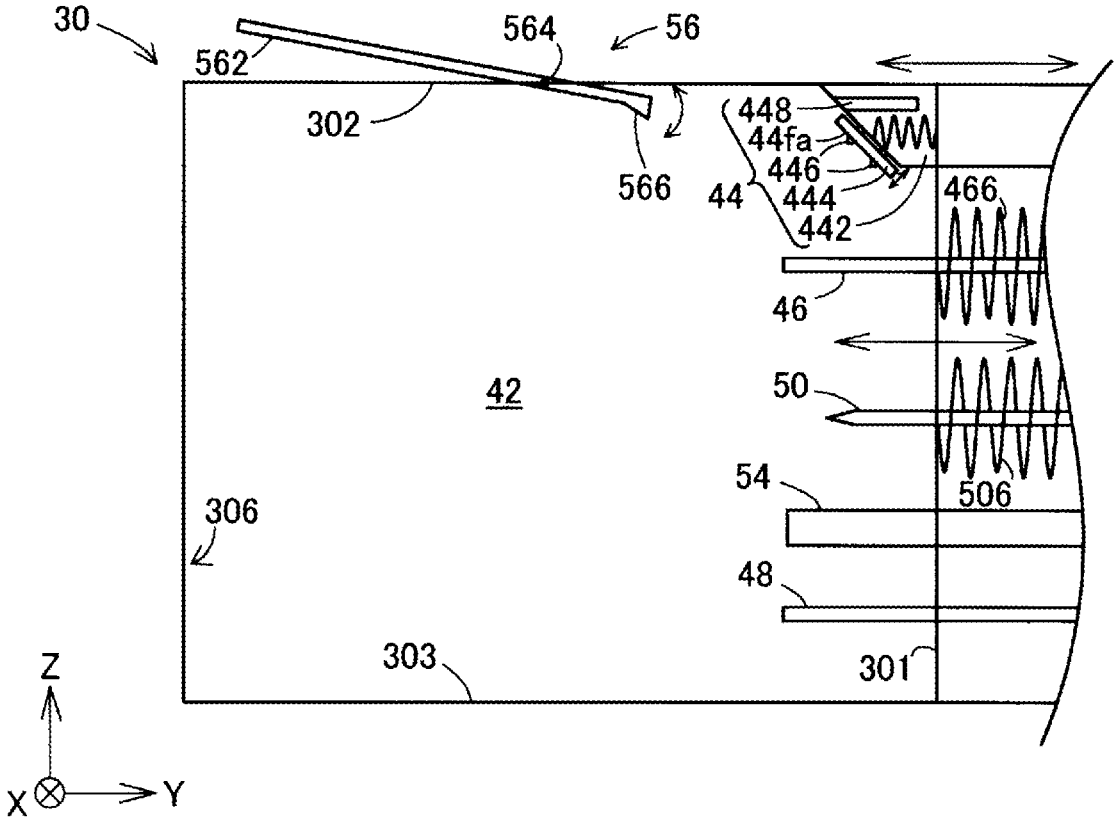
FIG. 2 is a first schematic cross-sectional view of a mounting unit.

FIG. 2 is a first schematic cross-sectional view of the mounting unit 30. FIG. 2 illustrates a schematic cross-sectional view in a YZ plane, which is a plane parallel to the Z direction, which is a direction vertical to the mounting unit 30, and the Y direction, which is the mounting/detaching direction. The mounting unit 30 forms a mounting space 42, which is an internal space having a substantially cuboid shape, for accommodating the liquid storage container 100 therein. The mounting unit 30 includes a mounting unit rear surface 301, a mounting unit top surface 302, a mounting unit bottom surface 303, and a mounting unit opening 306. The mounting unit top surface 302 and the mounting unit bottom surface 303 are walls each extending in the XY plane. The mounting unit top surface 302 defines the top surface of the mounting space 42. A lock lever 56 is provided on the mounting unit top surface 302. The mounting unit bottom surface 303 defines the bottom surface of the mounting space 42. The mounting unit opening 306 has an opening that is oriented in the −Y direction, which is the detaching direction, and allows the inside and the outside of the mounting space 42 to communicate with each other. Further, although not shown, side surfaces, each extending in the YZ plane, are provided on the closer and farther sides in the sheet of FIG. 2.

The mounting unit rear surface 301 is a wall located on the +Y side in the mounting direction. The mounting unit rear surface 301 is a wall extending in an XZ plane. The mounting unit rear surface 301 is provided with an apparatus-side terminal portion 44, a first positioning portion 46, a second positioning portion 48, and an introduction needle 50.

When the liquid storage container 100 is in a mounted state, the apparatus-side terminal portion 44 is in contact with a circuit board, described later, of the liquid storage container 100 to be electrically coupled thereto. The apparatus-side terminal portion 44 is provided on the mounting unit rear surface 301 at a position close to the mounting unit top surface 302. That is, the apparatus-side terminal portion 44 is provided at a position closer to the mounting unit top surface 302 than to the mounting unit bottom surface 303. The apparatus-side terminal portion 44 includes a bias member 442, a terminal holder 444, an apparatus-side terminal 446, and an apparatus-side guide portion 448. The apparatus-side terminal portion 44 further includes an apparatus-side guide portion 448.

The bias member 442 extends in the mounting/detaching direction, and the terminal holder 444 is attached to an end of the bias member 442 in the −Y direction, which is a detaching direction. The bias member 442 includes a coil spring as an elastic member, and is elastically deformable in the mounting/detaching direction. Accordingly, the bias member 442 can move the apparatus-side terminal 446 in the mounting/detaching direction in response to an external force.

The terminal holder 444 is a member that holds the apparatus-side terminal 446. A surface 44*fa* of the terminal holder 444 is inclined in a direction intersecting the mounting unit top surface 302 and the mounting unit rear surface 301. Specifically, a direction normal to the surface 44*fa* has components in the −Z direction and the −Y direction. The terminal holder 444 is elastically deformable. As the terminal holder 444 elastically deforms, the surface 44*fa* is displaced.

The apparatus-side guide portion 448 is a structure for positioning the apparatus-side terminal portion 44 relative to a container-side terminal portion 142, described later, provided on the liquid storage container 100. In the present embodiment, the apparatus-side guide portion 448 is a projection extending in the Y direction. When the liquid storage container 100 is mounted, the apparatus-side guide portion 448 can prevent the apparatus-side terminal portion 44 from moving in a direction other than the Y direction.

The apparatus-side terminal 446 is a metal plate member, and partially exposed from the surface 44*fa* of the terminal holder 444. The apparatus-side terminal 446 is elastically deformable, and the degree of exposure from the surface 44*fa* varies depending on the external force. Specifically, the larger the external force, the smaller the degree of exposure from the surface 44*fa* of the apparatus-side terminal 446.

The first positioning portion 46 is a protruding member extending from the mounting unit rear surface 301 toward the inside of the mounting space 42 in the detaching direction. The first positioning portion 46 is provided on the lower side with respect to the apparatus-side terminal portion 44 and on the upper side with respect to the center of the mounting space 42 in the Z direction. The first positioning portion 46 has a proximal end located on a side opposite to the mounting space 42 via the mounting unit rear surface 301. The first positioning portion 46 has a distal end protruding from the mounting unit rear surface 301 in the detaching direction. A first coil spring 466 is provided as an elastic member between the proximal end and the wall forming the mounting unit rear surface 301. As the apparatus-side terminal 446 elastically deforms, the first positioning portion 46 moves in the mounting/detaching direction. The first coil spring 466 may not be necessarily provided.

The second positioning portion 48, as with the first positioning portion 46, is a protruding member extending from the mounting unit rear surface 301 toward the inside of the mounting space 42 in the detaching direction. The first positioning portion 46 is provided on the lower side with respect to the center of the mounting space 42 in the Z direction. An elastic member is not provided between the second positioning portion 48 and the wall forming the mounting unit rear surface 301.

The introduction needle 50 is a cylindrical member extending from the mounting unit rear surface 301 toward the inside of the mounting space 42 in the detaching direction. When inserted into a liquid supply port of the liquid storage container 100, described later, the introduction needle 50 is coupled to the liquid supply port. The introduction needle 50 is provided on the lower side with respect to the apparatus-side terminal portion 44 and the first positioning portion 46, and on the upper side with respect to the center of the second positioning portion 48 in the Z direction. The introduction needle 50 has a proximal end located on a side opposite to the mounting space 42 via the mounting unit rear surface 301. The introduction needle 50 has a distal end protruding from the mounting unit rear surface 301 in the detaching direction. A second coil spring 506 is provided as an elastic member between the proximal end and the wall forming the mounting unit rear surface 301. As the second coil spring 506 elastically deforms, the introduction needle 50 moves in the mounting/detaching direction. The proximal end of the introduction needle 50 is coupled to the tube 38 shown in FIG. 1. The second coil spring 506 may not be necessarily provided.

A pressurizing unit 54 applies pressure to the inside of the liquid storage container 100 to thereby supply the liquid stored in the liquid storage container 100 to the head 32 shown in FIG. 1. In the present embodiment, the pressurizing unit 54 is a cylindrical member that circulates pressurized air, and applies pressure to the inside of the liquid storage container 100 by supplying the pressurized air to the inside of the liquid storage container 100. The pressurized air is generated by a pressurizing mechanism such as a pump, which is not shown, provided in the liquid ejection apparatus 10.

The lock lever 56 locks the liquid storage container 100 to thereby restrict the liquid storage container 100 in a mounted state from moving in the detaching direction. The lock lever 56 includes an operation portion 562, a rotation shaft 564 parallel with the X axis, and an apparatus-side locking portion 566. The operation portion 562 is located on one end of the lock lever 56. The apparatus-side locking portion 566 is located on the other end of the lock lever 56. The operation portion 562 is exposed to the outside of the mounting unit 30 so that a user can operate. The apparatus-side locking portion 566 is located inside the mounting unit 30. The lock lever 56 rotates about the rotation shaft 564. Accordingly, in the lock lever 56, as the operation portion 562 is operated, the apparatus-side locking portion 566 rotates about the X axis and is displaced in the Z direction.

Figure 3:
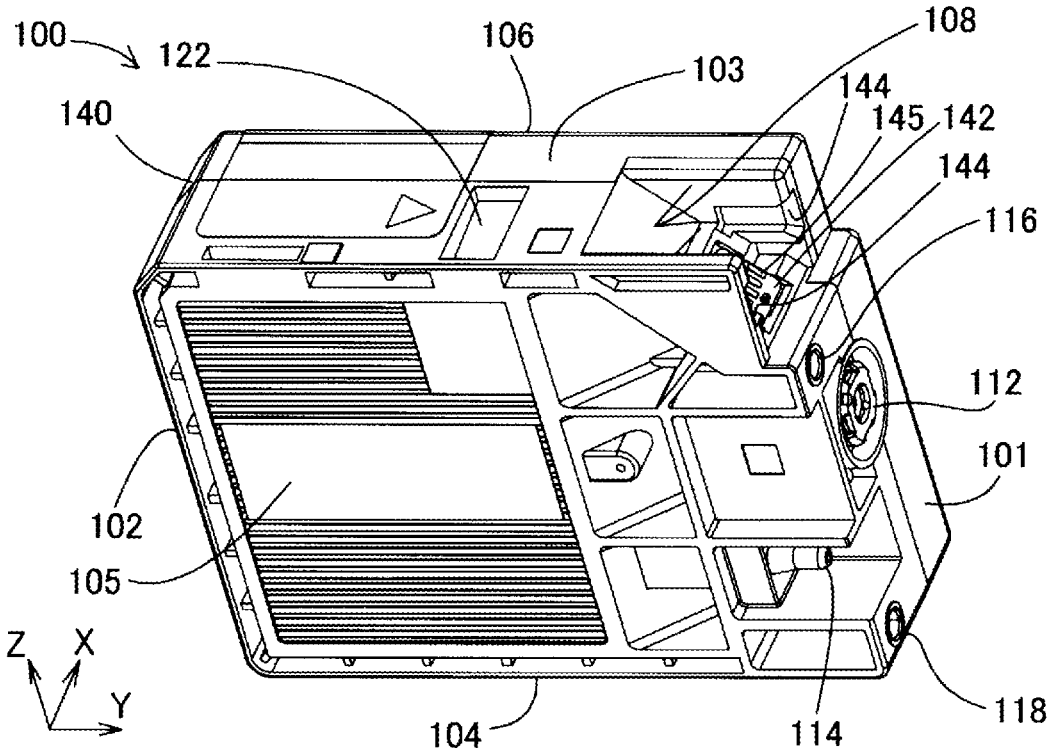
FIG. 3 is a perspective view of a liquid storage container.
Figure 4:
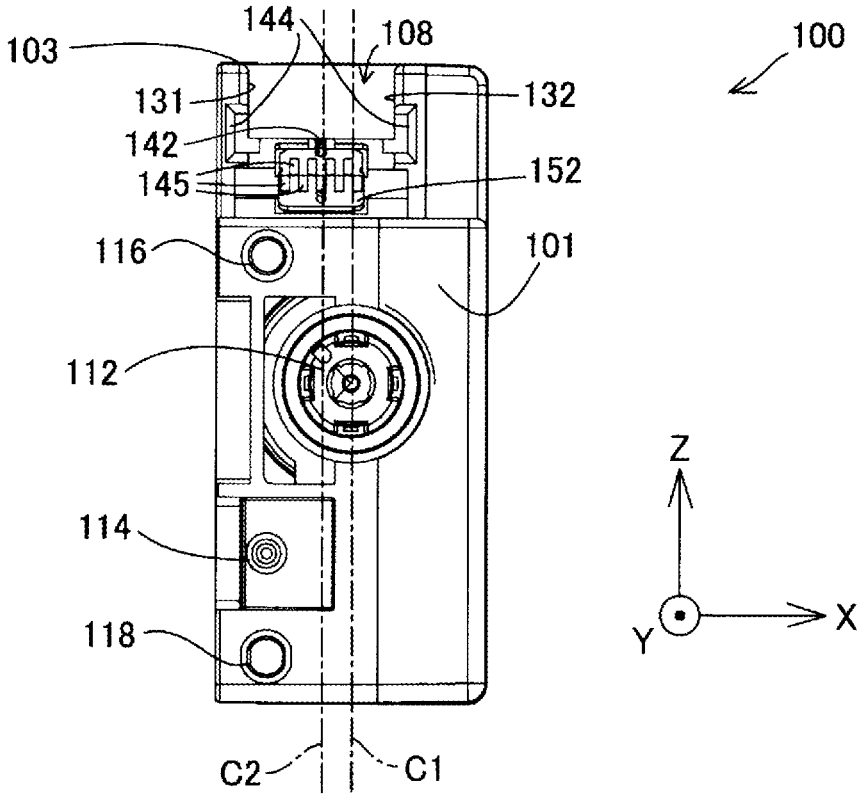
FIG. 4 is a front view of the liquid storage container.

FIG. 3 is a perspective view of the liquid storage container 100. FIG. 4 is a front view of the liquid storage container 100. As shown in FIG. 3, the liquid storage container 100 includes, as outer walls, a container front surface 101, a container rear surface 102, a container top surface 103, a container bottom surface 104, a container first side surface 105, a container second side surface 106, and a corner portion 108. In FIGS. 3 and 4, the liquid storage container 100 is illustrated with the X, Y, and Z axes in a state mounted in the liquid ejection apparatus 10. The respective surfaces 101 to 106 each have a substantially rectangular outer shape. In the liquid storage container 100, the X direction is a width direction, the Z direction is a height direction, and the Y direction is a depth direction.

As shown in FIG. 3, the container front surface 101 and the container rear surface 102 face each other in the Y direction. When the liquid storage container 100 is mounted in the mounting unit 30, the container front surface 101 is oriented in the mounting direction. That is, in the direction in which the container front surface 101 and the container rear surface 102 face each other, the direction oriented from the container rear surface 102 toward the container front surface 101 is the mounting direction.

The container top surface 103 and the container bottom surface 104 each intersect the container front surface 101 and the container rear surface 102. The container top surface 103 and the container bottom surface 104 face each other in the Z direction. The container top surface 103 is a wall located on the +Z side, which is the upper side in the vertical direction. The container bottom surface 104 is a wall located on the −Z side.

The container first side surface 105 and the container second side surface 106 each intersect the container front surface 101, the container rear surface 102, the container top surface 103, and the container bottom surface 104. The container first side surface 105 and the container second side surface 106 face each other in the X direction. The container first side surface 105 is a wall located on the −X side, and the container second side surface 106 is a wall located on the +X side.

As shown in FIGS. 3 and 4, the corner portion 108 is provided at a corner where the container front surface 101 and the container top surface 103 intersect each other. The corner portion 108 has a recessed shape in which the case 140 is recessed inward. The corner portion 108 is formed in part of the width of the liquid storage container 100 in the X direction between the container first side surface 105 and the container second side surface 106.

The container front surface 101 is provided with a supply port 112, a pressure port 114, a first positioning hole 116, and a second positioning hole 118. The container top surface 103 is provided with a container-side locking portion 122, which is locked by the lock lever 56. The corner portion 108 is provided with a container-side terminal portion 142 and a container-side guide portion 144.

The supply port 112 has an opening into which the introduction needle 50 is inserted when the liquid storage container 100 is mounted in the mounting unit 30. When the introduction needle 50 is inserted into the supply port 112, the supply port 112 communicates the inside of the liquid storage body 130 with the introduction needle 50. As shown in FIG. 4, the supply port 112 is provided in the center area of the container front surface 101.

The pressure port 114 communicates the outside and the inside of the case 140 with each other. The pressure port 114 is a cylindrical member extending from the container front surface 101 in the +Y direction. The pressure port 114 is coupled to the pressurizing unit 54 when the liquid storage container 100 is mounted in the mounting unit 30.

The first positioning hole 116 is located at a position closer to the container top surface 103 than the supply port 112 and the pressure port 114 are. The first positioning hole 116 is a recess extending from the container front surface 101 toward the inside of the case 140 in the −Y direction. The first positioning hole 116 has a circular cross-sectional shape in the direction along the container front surface 101. The first positioning portion 46 is inserted into the first positioning hole 116 when the liquid storage container 100 is mounted in the mounting unit 30.

The second positioning hole 118 is located at a position closer to the container bottom surface 104 than the supply port 112, the pressure port 114 and the first positioning hole 116 are. The second positioning hole 118 is a recess extending from the container front surface 101 toward the inside of the case 140 in the +Y direction. The first positioning hole 116 has an oval cross-sectional shape in the direction along the container front surface 101. The second positioning portion 48 is inserted into the second positioning hole 118 when the liquid storage container 100 is mounted in the mounting unit 30.

The container-side locking portion 122 is a recess formed on the container top surface 103. The container-side locking portion 122 is locked by the apparatus-side locking portion 566 when the liquid storage container 100 is in a mounted state. Thus, the liquid storage container 100 is restricted from moving in the detaching direction.

The container-side terminal portion 142 is a circuit board. The container-side terminal portion 142 includes a plurality of substrate terminals 145 provided on a substrate surface 152. The substrate surface 152 is inclined so as to extend in a direction intersecting the container top surface 103 and the container front surface 101. Specifically, a direction normal to the substrate surface 152 has components in the +Z direction and the +Y direction. In the present embodiment, the container-side terminal portion 142 is provided on the +Z side with respect to the center of the liquid storage container 100 in the Z direction. The substrate terminal 145 is electrically coupled to the apparatus-side terminal 446. As the substrate terminal 145 of the container-side terminal portion 142 is electrically coupled to the apparatus-side terminal 446 of the apparatus-side terminal portion 44, various types of information are transmitted or received between a memory chip, which is not shown, provided on the container-side terminal portion 142 and the liquid ejection apparatus 10. The various types of information may be, for example, the type or the date of manufacture of the liquid stored in the liquid storage container 100.

In the present embodiment, the container-side terminal portion 142 is provided in the corner portion 108, which is an outer wall of the case 140. With this configuration, it is not necessary to provide a separate member for attaching the container-side terminal portion 142 to the liquid storage container 100. Accordingly, the manufacturing cost of the liquid storage container 100 can be reduced. In addition, the container-side terminal portion 142 may also be attached to the corner portion 108, which is an outer wall of the case 140, via a separate member.

The container-side guide portion 144 has a shape corresponding to the apparatus-side guide portion 448. In the present embodiment, the container-side guide portion 144 is a groove extending in the Y axis direction, which is provided on each of two side walls 131 and 132 that form the corner portion 108. When the liquid storage container 100 is mounted in the mounting unit 30, the projection as the apparatus-side guide portion 448 is fitted into the groove as the container-side guide portion 144.

As shown in FIG. 4, the container-side terminal portion 142 is provided at a position offset from the center of the container front surface 101 in the X direction. The position offset from a center line C1, which is the center of the container front surface 101, means that the center line C1 does not overlap a center line C2 of the container-side terminal portion 142 in the X direction. More preferably, the center line C1 of the container front surface 101 does not overlap the container-side terminal portion 142. In other words, the container-side terminal portion 142 is provided at a position offset from the center of the front surface in the direction perpendicular to the vertical direction and the mounting direction. The vertical direction is referred to as a first direction. Accordingly, the internal space of the liquid storage container 100, specifically, the internal space of the case 140 can be easily ensured. Thus, the volume of the liquid storage body 130 shown in FIG. 1 can be easily increased. In addition, the container-side terminal portion 142 may also be provided at the center of the container front surface 101 in the X direction.

Further, the container-side terminal portion 142 is provided at a position offset from the supply port 112, the pressure port 114, the first positioning portion 46, and the second positioning hole 118 in the X direction. Specifically, the center line C2 of the container-side terminal portion 142 does not overlap the respective centers of the supply port 112, the pressure port 114, the first positioning portion 46, and the second positioning hole 118 in the X direction. More preferably, the center line C2 of the container-side terminal portion 142 does not overlap the supply port 112, the pressure port 114, the first positioning portion 46, and the second positioning hole 118. This can prevent or reduce the dust, which may be generated in attachment of the container-side terminal portion 142 to the corner portion 108, from adhering to the supply port 112, the pressure port 114, the first positioning portion 46, and the second positioning portion 48.

Figure 5:
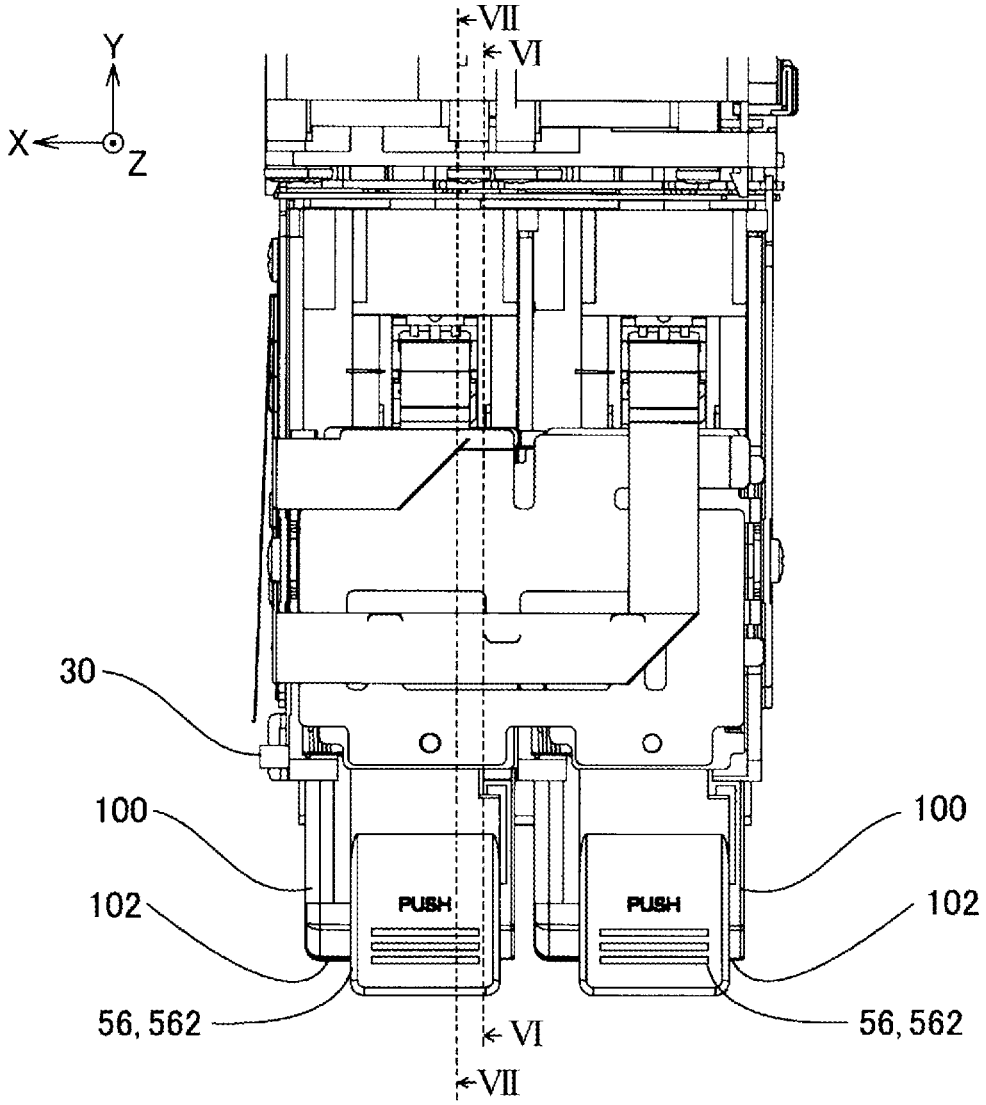
FIG. 5 is a top view of the liquid storage container and the mounting unit in a mounted state.

FIG. 5 is a top view of the liquid storage container 100 and the mounting unit 30 in a mounted state. FIG. 5 illustrates a view of the mounting unit 30 when viewed in the vertical direction from the upper side toward the lower side. In the mounted state, a part of the operation portion 562 of the lock lever 56 is exposed to the outside of the mounting unit 30. Accordingly, the operation portion 562 can be directly operated by a user. Further, a part of the liquid storage container 100, specifically, the container rear surface 102 of the liquid storage container 100 is exposed to the outside of the mounting unit 30. Accordingly, the user can pull out the liquid storage container 100 by grabbing it from a side of the container rear surface 102 when removing the liquid storage container 100 from the mounting unit 30.

Figure 6:
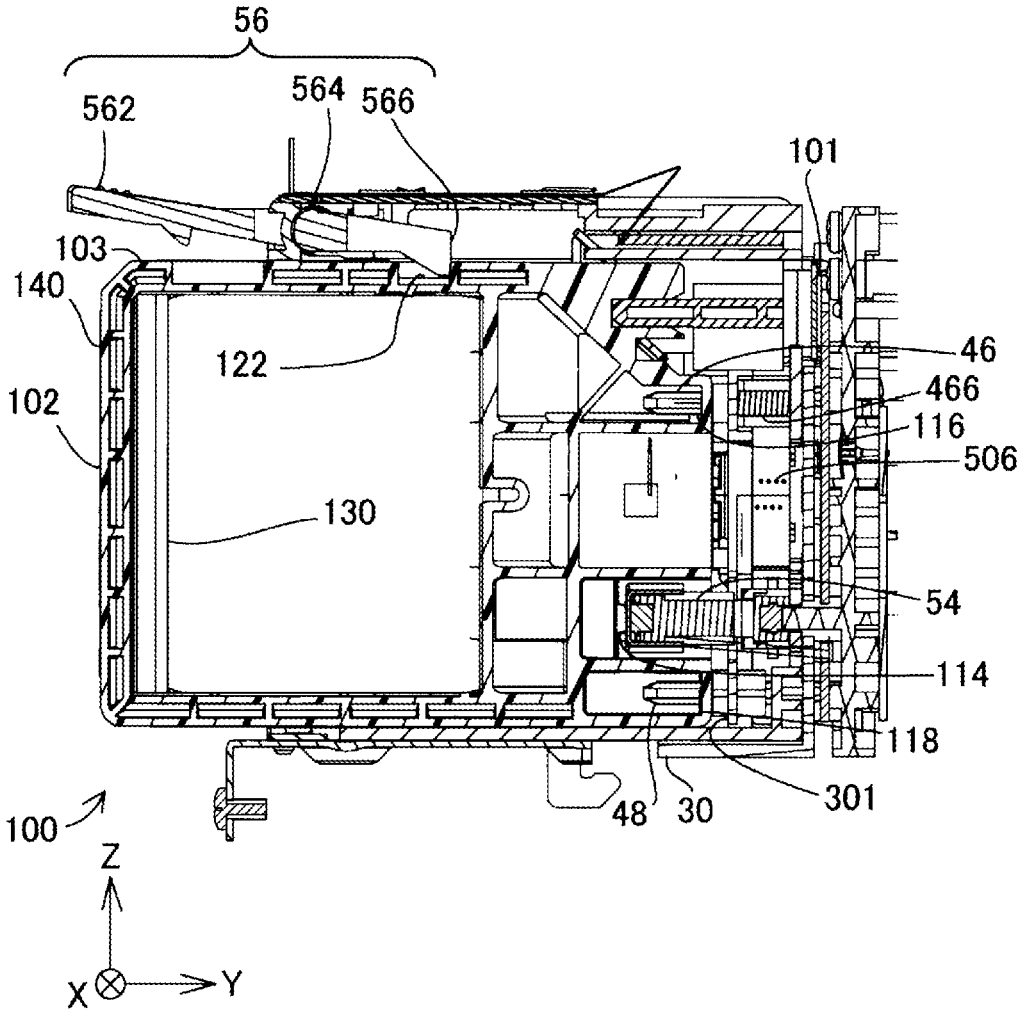
FIG. 6 is a cross-sectional view of the liquid storage container in a mounted state taken along the line VI-VI in FIG. 5.

FIG. 6 is a cross-sectional view of the liquid storage container 100 in a mounted state taken along the line VI-VI in FIG. 5. The cross-section taken along the line VI-VI in FIG. 5 is a cross-section passing through the center line of the first positioning hole 116 in the X direction shown in FIG. 4.

In the mounted state, the pressure port 114 is coupled to the pressurizing unit 54. This allows a pressurized fluid to be supplied to the inside of the case 140. As the pressurized fluid is supplied to the inside of the case 140, the liquid storage body 130 is pressurized. Accordingly, liquid in the liquid storage body 130 is supplied to the introduction needle 50 via the supply port 112.

In the mounted state, the first positioning portion 46 is inserted into the first positioning hole 116. Accordingly, it is possible to prevent or reduce the liquid storage container 100 in the mounting unit 30 from being displaced. The first coil spring 466 is disposed at the proximal end of the first positioning portion 46. Accordingly, a biasing force toward the detaching direction is applied to the liquid storage container 100.

In the mounted state, the second positioning portion 48 is inserted into the second positioning hole 118. Accordingly, it is possible to prevent or reduce the liquid storage container 100 in the mounting unit 30 from being displaced. In addition, a gap is formed between the second positioning hole 118 and the second positioning portion 48.

The second coil spring 506 is disposed at the proximal end of the introduction needle 50. Accordingly, a biasing force toward the detaching direction is applied to the liquid storage container 100.

Figure 7:
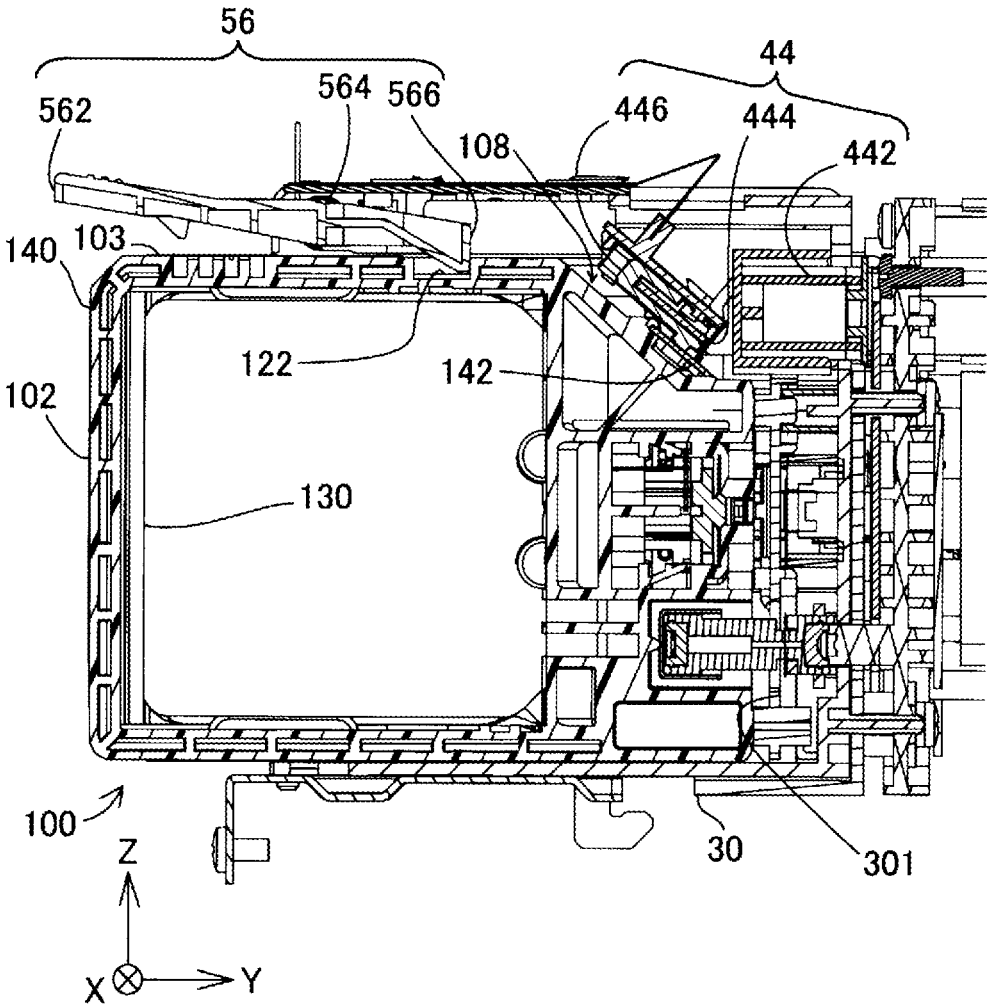
FIG. 7 is a cross-sectional view of the liquid storage container in a mounted state taken along the line VII-VII in FIG. 5.

FIG. 7 is a cross-sectional view of the liquid storage container 100 in a mounted state taken along the line VII-VII in FIG. 5. The cross-section taken along the line VII-VII in FIG. 5 is a cross-section passing through the center line of the container-side terminal portion 142 in the X direction shown in FIG. 4. A contact position between the apparatus-side terminal portion 44 and the container-side terminal portion 142, and a position where the lock lever 56 is locked by the container-side locking portion 122 are overlapped with each other in the Y direction.

In mounting of the liquid storage container 100 in the mounting unit 30, as the apparatus-side terminal portion 44 is biased by the container-side terminal portion 142, the bias member 442 and the terminal holder 444 are elastically deformed. Specifically, the bias member 442 is compressed in the Y direction, which is the mounting direction. Further, the terminal holder 444 is compressed in the direction normal to the substrate surface 152. Accordingly, the apparatus-side terminal portion 44 moves following the container-side terminal portion 142. As a result, in the mounted state, the apparatus-side terminal 446 of the apparatus-side terminal portion 44 and the substrate terminal 145 of the container-side terminal portion 142 are in contact with each other. Since the bias member 442 is compressed in the mounted state, the biasing force by the bias member 442 in the −Y direction is applied to the container-side terminal portion 142. Further, a biasing force by the terminal holder 444 in the direction intersecting the container-side terminal portion 142 is applied to the container-side terminal portion 142. In addition, the liquid storage container 100 is restricted by the lock lever 56 from moving in the −Y direction. Accordingly, a state in which the container-side terminal portion 142 is pressed against the apparatus-side terminal portion 44 is maintained. As a result, the apparatus-side terminal portion 44 and the container-side terminal portion 142 are in contact with each other in an appropriate manner. In addition, among the biasing forces applied to the liquid storage container 100, the largest biasing force is a biasing force applied by the bias member 442 in the −Y direction to the liquid storage container 100.

Figure 8:
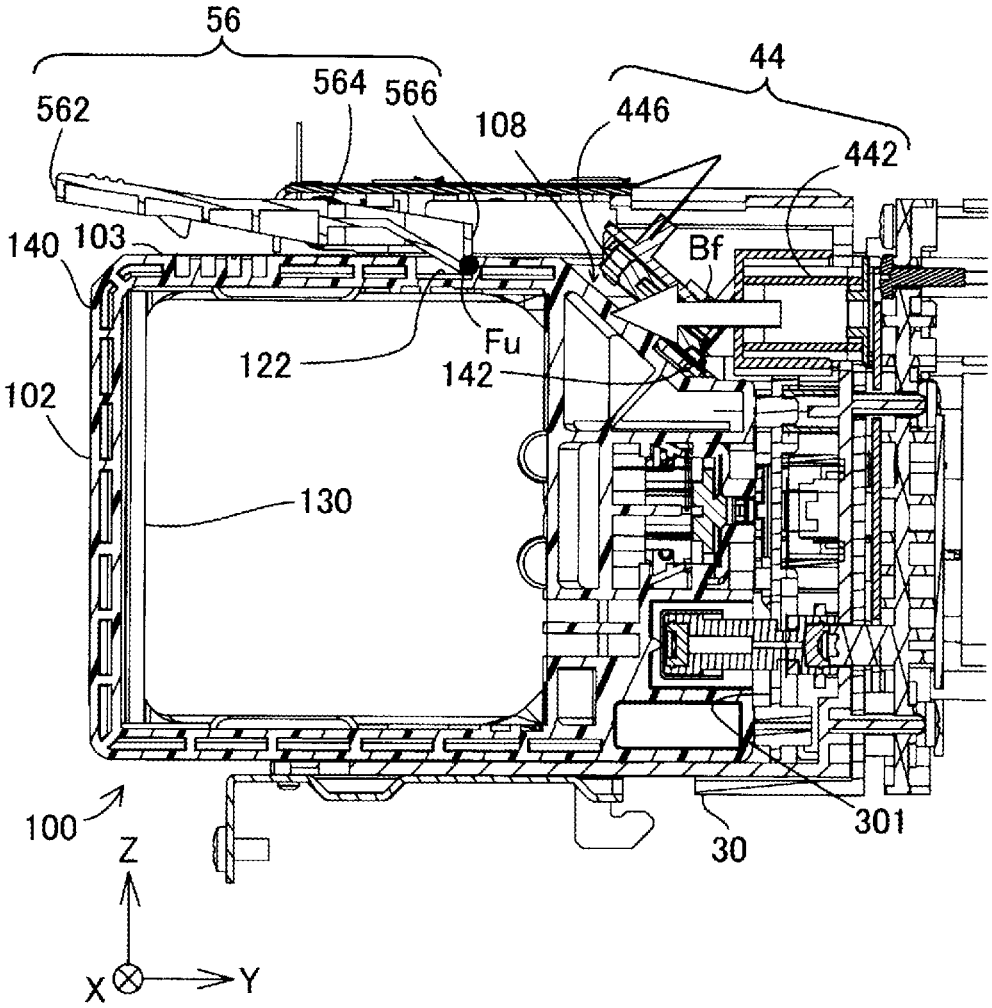
FIG. 8 is a diagram illustrating a biasing force that acts on the liquid storage container in a mounted state.

FIG. 8 is a diagram illustrating a moment that acts on the liquid storage container 100 in a mounted state. In the mounted state, a moment with the locking portion 122 as a fulcrum Fu is generated in the liquid storage container 100. The container-side terminal portion 142 that receives a biasing force Bf from the apparatus-side terminal portion 44 and the container-side locking portion 122 that locks the liquid storage container 100 at the fulcrum Fu of the rotation by the biasing force Bf are located at close positions in the vertical direction. Accordingly, the moment applied to the liquid storage container 100 by the bias member 442 is reduced.

According to the embodiment described above, the liquid ejection system 1 can reduce a moment caused by the biasing force Bf, which is the largest biasing force applied by the bias member 442. Therefore, occurrence of contact failure between the container-side terminal portion 142 and the apparatus-side terminal portion 44 due to a rotation force of the liquid storage container 100 can be reduced.

Further, according to the embodiment described above, in the liquid ejection system 1, the first positioning portion 46 and the introduction needle 50 are disposed so as not to be disposed closer to the container bottom surface 104 than to the container top surface 103 in the liquid storage container 100. Accordingly, a moment that is generated due to the biasing force applied to the liquid storage container 100 by the first coil spring 466 and the second coil spring 506 with the locking portion 122 provided on the container top surface 103 as a fulcrum can be reduced. Therefore, occurrence of contact failure between the container-side terminal portion 142 and the apparatus-side terminal portion 44 due to a rotation force of the liquid storage container 100 can be further reduced.

B. Other Embodiments

B1. First Other Embodiment

In the above embodiment, the container-side terminal portion 142 is provided in the corner portion 108. However, the container-side terminal portion 142 may be disposed at any position. For example, the container-side terminal portion 142 may be disposed on the upper side with respect to the center of the container front surface 101 in the Z direction. In this case as well, the liquid ejection system 1 can reduce a moment caused by the bias member 442 compared with the case in which the container-side terminal portion 142 is provided on the lower side with respect to the center of the container front surface 101 in the Z direction. In this case, the container-side terminal portion 142 may not be necessarily inclined relative to the container front surface 101 and the container top surface 103.

B2. Second Other Embodiment

In the above embodiment, the liquid storage container 100 includes the liquid storage body 130. However, the embodiment is not limited thereto. For example, the liquid storage container 100 may not necessarily include the liquid storage body 130. Specifically, the case 140 may form a space that stores liquid. In this case, the case 140 may include a member such as a sponge that assists collection of liquid.

B3. Third Other Embodiment

In the above embodiment, the liquid storage container 100 has the pressure port 114. However, the embodiment is not limited thereto. For example, the liquid storage container 100 may not necessarily have the pressure port 114. In this case, for example, the liquid ejection apparatus 10 may include a suction mechanism such as a pump that suctions liquid from the liquid storage container 100.

B4. Fourth Other Embodiment

In the above embodiment, the mounting unit 30 includes the lock lever 56 as a member that locks the liquid storage container 100. However, the embodiment is not limited thereto. The mounting unit 30 may also include, instead of the lock lever 56, various members that can lock the container-side locking portion 122 provided on the container top surface 103 of the liquid storage container 100.

B5. Fifth Other Embodiment

In the above embodiment, the liquid ejection system 1 includes the apparatus-side guide portion 448 and the container-side guide portion 144. However, the embodiment is not limited thereto. The liquid ejection system 1 may not necessarily include the apparatus-side guide portion 448 and the container-side guide portion 144.

B6. Sixth Other Embodiment

In the above embodiment, the positions where the supply port 112, the pressure port 114, the first positioning hole 116, and the second positioning hole 118 are provided are not limited. The positions where the supply port 112, the pressure port 114, the first positioning hole 116, and the second positioning hole 118 are provided may be modified as appropriate. For example, the supply port 112 and the first positioning hole 116 may be provided on the container front surface 101 at positions closer to the container bottom surface 104 than to the container top surface 103. Further, at least one of the supply port 112, the pressure port 114, the first positioning hole 116, and the second positioning hole 118 may be provided at positions overlapping the container-side terminal portion 142 in the X direction.

In the above first to sixth embodiments as well, the same effect as that of the aforementioned embodiment can be achieved since they have the same configuration.

B7. Seventh Other Embodiment

The present disclosure is not limited to ink jet printers, and ink tanks for supplying ink to ink jet printers, and can also be applied to liquid ejection apparatuses that eject various liquid including ink, and liquid tanks for storing the liquid. For example, the present disclosure can be applied to various liquid ejection apparatuses and their liquid tanks as follows.

(1) Image recording apparatuses such as facsimile machines (2) Color material ejection apparatuses used for manufacturing color filters for image display apparatuses such as liquid crystal displays (3) Electrode material ejection apparatuses used for forming electrodes of organic EL (electro luminescence) displays, surface emitting displays (field emission displays, FEDs), and the like (4) Liquid ejection apparatuses for ejecting liquid including bioorganic substances used for manufacturing biochips (5) Sample ejection apparatuses as precision pipettes (6) Lubricant ejection apparatuses (7) Resin liquid ejection apparatuses (8) Liquid ejection apparatuses that eject lubricant in a pinpoint manner onto precision machines such as watches and cameras (9) Liquid ejection apparatuses that eject transparent resin liquid such as an ultraviolet curable resin liquid onto a substrate for forming micro hemisphere lenses (optical lenses) used for optical communication elements and the like

(10) Liquid ejection apparatuses that eject acidic or alkaline etching solution for etching a substrate and the like

(11) Liquid ejection apparatuses including a liquid ejection head that ejects any other small amount of liquid droplets The "liquid droplets" refers to a state of liquid ejected from the liquid ejection apparatus, and includes granular shape, tear shape, and thread shape in a trailing shape. Further, the term "liquid" as used herein refers to any material that can be ejected by the liquid ejection apparatus. For example, "liquid" may be a material in a state of a liquid phase, and includes liquid state materials having high or low viscosity, and liquid state materials such as sol, gel water, other inorganic solvents, organic solvents, solutions, liquid resins, liquid metal (melt metal). The "liquid" further includes, in addition to liquid as one state of substances, materials in which particles of a functional material having solids such as pigments and metal particles are dissolved, dispersed, or mixed in a solvent. In addition, representative examples of the liquid include ink described in the above embodiment, liquid crystals and the like. Here, the ink is intended to include various types of liquid compositions such as general water-based ink, oil-based ink, gel ink and hot melt ink.

The present disclosure is not limited to the above embodiments and can be embodied in various configurations without departing from the spirit thereof. For example, technical features in the embodiments corresponding to the technical features in the respective embodiments described in the summary can be appropriately replaced or combined in order to solve part or all of the above problems or achieve part or all of the above effects. Further, technical features can be appropriately deleted as long as they are not described in the specification as indispensable features.

(1) According to an embodiment of the present disclosure, a liquid ejection system is provided. The liquid ejection system includes: a liquid ejection apparatus that ejects liquid; and a liquid storage container that is detachably mounted in the liquid ejection apparatus, the liquid storage container storing the liquid to be ejected by the liquid ejection apparatus, wherein the liquid ejection apparatus includes: a mounting unit in which the liquid storage container is mounted, the mounting unit having an apparatus-side terminal portion that is elastically deformable at least in a horizontal direction which is parallel to a mounting direction of the liquid storage container, and an apparatus-side locking portion that restricts the liquid storage container from moving in a direction opposite to the mounting direction, and the liquid storage container includes: a top surface that is located on an upper side in a vertical direction in a mounted state in which the liquid storage container is mounted in the mounting unit; a container-side locking portion locked by the apparatus-side locking portion, the container-side locking portion being provided on the top surface; and a container-side terminal portion configured to be coupled to the apparatus-side terminal portion, the container-side terminal portion being provided at a position closer to the top surface than to a center of the liquid storage container in the vertical direction. According to the liquid ejection system of this embodiment, the container-side terminal portion that receives a biasing force from the apparatus-side terminal portion and the container-side locking portion that serves as the fulcrum of the rotation by the biasing force are located at close positions in the vertical direction. For this reason, a moment that is a rotation force applied to the liquid storage container is reduced. Therefore, occurrence of contact failure between the container-side terminal portion and the apparatus-side terminal portion due to a rotation force of the liquid storage container can be reduced.

(2) In the above aspect, the liquid storage container may further includes: a front surface, which is an outer wall oriented in the mounting direction; and a corner portion located at an intersection between the front surface and the top surface, the corner portion having the container-side terminal portion, and the container-side terminal portion may include a substrate terminal disposed on a surface inclined relative to the top surface and the front surface in the corner portion. According to the liquid ejection system of this embodiment, the container-side terminal portion that receives a biasing force from the apparatus-side terminal portion and the container-side locking portion that serves as the fulcrum of the rotation by the biasing force can be located at closer positions in the vertical direction. Therefore, occurrence of contact failure between the container-side terminal portion and the apparatus-side terminal portion due to a rotation force of the liquid storage container can be more appropriately reduced.

(3) In the above aspect, the container-side terminal portion may be disposed at a position offset from a center of the front surface in a first direction, which is perpendicular to the vertical direction and the mounting direction. According to the liquid ejection system of this embodiment, an internal space of the liquid storage container can be easily ensured.

(4) In the above aspect, the mounting unit may further include a positioning portion having a protruding shape for positioning the liquid storage container, the front surface of the liquid storage container may be provided with a supply port having an opening for supplying the liquid to the liquid ejection apparatus, a pressure port having an opening for pressurizing the liquid, and a positioning hole into which the positioning portion is inserted, and the container-side terminal portion may be disposed at a position offset from the supply port, the pressure port, and the positioning portion in the first direction. According to the liquid ejection system of this embodiment, the dust, which may be generated in attachment of the container-side terminal portion, from adhering to the supply port, the pressure port, and the positioning portion.

(5) In the above aspect, the liquid storage container may include: a liquid storage body, which is a bag member having a bag shape for storing the liquid; and a housing that accommodates the liquid storage body, and the container-side terminal portion may be provided on the housing. According to the liquid ejection system of this embodiment, the number of parts can be reduced compared with a case in which the container-side terminal portion is separately provided.

The present disclosure can be embodied in various embodiments other than liquid ejection systems. For example, the present disclosure can be embodied as a method for manufacturing a liquid storage container, a liquid ejection system or a liquid storage container.

What is claimed is:

1. A liquid ejection system comprising:

a liquid ejection apparatus that ejects liquid; and a liquid storage container that is detachably mounted in the liquid ejection apparatus, the liquid storage container storing the liquid to be ejected by the liquid ejection apparatus, wherein the liquid ejection apparatus includes: a mounting unit in which the liquid storage container is mounted, the mounting unit having an apparatus-side terminal portion that is elastically deformable at least in a horizontal direction which is parallel to a mounting direction of the liquid storage container, and an apparatus-side locking portion that restricts the liquid storage container from moving in a direction opposite to the mounting direction, the apparatus-side locking portion being integral with an operation portion, an entire outer edge of the apparatus-side locking portion being collinear with and extending along a same line as an entire outer edge of the operation portion, the operation portion extending outside of the mounting unit and configured to be operated by a user, and the liquid storage container includes: a top surface that is located on an upper side in a vertical direction in a mounted state in which the liquid storage container is mounted in the mounting unit; a container-side locking portion locked by the apparatus-side locking portion, the container-side locking portion being provided on the top surface; and a container-side terminal portion configured to be coupled to the apparatus-side terminal portion, the container-side terminal portion being provided at a position closer to the top surface than to a center of the liquid storage container in the vertical direction.

2. The liquid ejection system according to claim 1, wherein the liquid storage container further includes: a front surface, which is an outer wall oriented in the mounting direction; and a corner portion located at an intersection between the front surface and the top surface, the corner portion having the container-side terminal portion, and the container-side terminal portion includes a substrate terminal disposed on a surface inclined relative to the top surface and the front surface in the corner portion.

3. The liquid ejection system according to claim 2, wherein the container-side terminal portion is disposed at a position offset from a center of the front surface in a first direction, which is perpendicular to the vertical direction and the mounting direction.

4. The liquid ejection system according to claim 3, wherein the mounting unit further includes a positioning portion having a protruding shape for positioning the liquid storage container, the front surface of the liquid storage container is provided with a supply port having an opening for supplying the liquid to the liquid ejection apparatus, a pressure port having an opening for pressurizing the liquid, and a positioning hole into which the positioning portion is inserted, and the container-side terminal portion is disposed at a position offset from the supply port, the pressure port, and the positioning portion in the first direction.

5. The liquid ejection system according to claim 1, wherein the liquid storage container includes: a liquid storage body, which is a bag member having a bag shape for storing the liquid; and a housing that accommodates the liquid storage body, and the container-side terminal portion is provided on the housing.

* * * * *